US007952287B2

(12) United States Patent
Barnett et al.

(10) Patent No.: US 7,952,287 B2
(45) Date of Patent: May 31, 2011

(54) TRAVELING-WAVE TUBE 2D SLOW WAVE CIRCUIT

(76) Inventors: Larry R. Barnett, Normandy, TN (US); Young-Min Shin, Seoul (KR)

( * ) Notice: Subject to any disclaimer, the term of this patent is extended or adjusted under 35 U.S.C. 154(b) by 497 days.

(21) Appl. No.: 12/248,019

(22) Filed: Oct. 8, 2008

(65) Prior Publication Data

US 2009/0096378 A1 Apr. 16, 2009

Related U.S. Application Data

(60) Provisional application No. 60/979,392, filed on Oct. 12, 2007.

(51) Int. Cl.
*H01J 25/34* (2006.01)

(52) U.S. Cl. ..... 315/3.5; 315/39.3

(58) Field of Classification Search ..... 315/3.5, 315/3.6, 39.3, 39.51, 4, 5, 382, 500, 505, 315/506, 5.39, 5.41, 5.42, 5.43
See application file for complete search history.

(56) References Cited

U.S. PATENT DOCUMENTS 3,860,880 A 1/1975 Yariv et al.
4,091,311 A * 5/1978 Mendelsohn et al. ..... 315/382
4,389,593 A * 6/1983 DeSantis et al. ..... 315/4
4,578,620 A * 3/1986 James et al. ..... 315/3.5
4,695,766 A 9/1987 Waterman
4,765,056 A 8/1988 Harper et al.
5,834,971 A 11/1998 Giguere et al.
6,369,511 B1 4/2002 Matsuoka et al.
6,664,734 B1 12/2003 Jasper, Jr.
6,747,412 B2 6/2004 Vancil

OTHER PUBLICATIONS

Young-Min Shina and Larry R. Barnett, Intense wideband terahertz amplification using phase shifted periodic electron-plasmon coupling, American Institute of Physics, Applied Physics Letters 92, 091501, published online Mar. 3, 2008 at http://dx.doi.org/10.1063/1.2883951.

* cited by examiner

*Primary Examiner* — David Hung Vu
(74) *Attorney, Agent, or Firm* — Louis Ventre, Jr.

(57) ABSTRACT

A two-dimensional circuit for a traveling-wave tube for millimeter and sub-millimeter electromagnetic waves synchronously interacts with an electron beam in a vacuum electronic microwave amplifier or oscillator. The circuit is a solid body having a length along the tube axis. The solid body has an electrically conductive top section and an electrically conductive bottom section. The top section is configured with a plurality of vertical vanes having a width and height and configured parallel to each other. The bottom section is similarly configured such that when the circuit is viewed in cross section along the length, the vanes on the bottom section are staggered with respect to the vanes on the top section. The top section and the bottom section are separated from each other to define a tunnel through the solid body along the length.

7 Claims, 4 Drawing Sheets

TRAVELING-WAVE TUBE 2D SLOW WAVE CIRCUIT

CROSS-REFERENCE TO RELATED APPLICATIONS

This application claims the benefit of the filing date of prior-filed U.S. provisional application 60/979,392, filed 12 Oct. 2007, which is hereby incorporated by reference herein.

TECHNICAL FIELD

In the field of amplifiers and oscillators, a traveling wave tube interaction circuit having means therein for propagating an electromagnetic wave or component thereof at a velocity reduced from the free space velocity of the wave and propagated in proximity to an electron stream, permitting exchange of energy between the electrons and the electromagnetic wave.

BACKGROUND ART

Conventional traveling-wave tubes utilize a slow wave structure through which an electron beam passes. In the traveling-wave tube, electrons in the beam travel with velocities slightly greater than that of a radio frequency wave, and on the average are slowed down by the field of the wave. A loss of kinetic energy of the electrons appears as increased energy conveyed to the field of the wave. The traveling wave tube may be employed as an amplifier or an oscillator.

Staggered traveling-wave tube circuits in the prior art have an overlapping vanes with a small beam tunnel through the overlapping vanes. This type of prior art is illustrated in U.S. Pat. No. 6,747,412, teaching the use of a slow-wave structure of two intermeshing combs in combination with other components.

It had been settled wisdom that to have sufficient beam-microwave interaction strength to amplify a microwave signal, the circuit vanes, comb teeth, or simply parts must overlap to form a folded waveguide circuit. Having non-overlapping or intermeshed parts in a functional circuit was thought to be impossible.

A folded waveguide circuit also has strong symmetric field for the lowest mode. The microwave electron circuits in the frequency range below 100 gigahertz (GHz) have been manually fabricated by mechanical machining techniques. As the operation frequency of microwave amplifiers has increased, cutting-edge Micro-ElectroMechanical Systems (MEMS) techniques, such as lithography and etching, have become the preferred approaches to fabricate micro-circuits. However, despite many attempts and progress to three-dimensionally micro-fabricate folded waveguide traveling-wave-tube circuits, construction of the beam tunnel across the waveguides has always been problematic.

A key innovation of the present invention is a configuration that enables the elimination of interleaved, overlapping or intermeshing vanes.

In addition, other conventional traveling-wave-tube circuits such as the helix transmission line, folded waveguide, coupled-cavity, and conventional single- and double-vane-based circuits, and others, have technical limitations in high-frequency applications that result in lower performance levels than with the present invention.

SUMMARY OF INVENTION

A circuit for a traveling-wave tube for millimeter and sub-millimeter electromagnetic waves synchronously interacts with an electron beam in a vacuum electronic microwave amplifier or oscillator. The circuit is made of a solid-body two-dimensional structure. The structure has a top section and a bottom section both of electrically conducting material. The top section is configured with a plurality of vertical vanes having a width and height and configured parallel to each other. The bottom section is similarly configured such that when the circuit is viewed in cross section along the length, the vanes on the bottom section are staggered with respect to the vanes on the top section. The top section and the bottom section are separated from each other to define a tunnel through the structure along the length.

Technical Problem

Although a variety of electronic circuits have been utilized for microwave tube applications, technical limitations, such as small dimensions and thermal loading, make it difficult, or even impossible, to apply the concepts to practical devices as the desired operating wavelengths are decreased to low millimeter and sub-millimeter wavelengths (i.e., to high GHz and terahertz (THz) frequencies) and as power levels are increased.

The prior art's overlapping vane configuration was thought to be essential in proper functioning of the traveling-wave tube. An overlapping vanes configuration with its inherent small beam tunnel, constrains the beam current and power, and the consequent tube microwave power.

Also, the prior art has practical manufacturing limitations when very high frequency (e.g. low millimeter wavelengths and sub-millimeter wavelengths) are desired. The prior art makes it difficult, if not effectively precluding, manufacture of a functional traveling-wave tube when the dimensions become on the order of tens of microns.

The prior art also teaches another difficult to manufacture circuit in which a linear electron beam periodically encounters the circuit wave travelling along the serpentine waveguide through the open-channels of the beam tunnel. In the fabrication for high frequency applications, the beam tunnel is troublesome because even conventional high speed machining produces mechanical and/or thermal damage and geometrical distortions together with large fabrication errors and poor dimensional accuracy. Even with the microfabrication techniques of lithography and etching processes, rods typically employed are physically isolated from the outer circuit-wall owing to the presence of the beam tunnel and are easily detached from a substrate by chemical attack associated with the development process because there is only weak mechanical adhesion with the circuit-top and -bottom. The drawbacks related to these technical issues critically deteriorate device performance and significantly cut down productivity of the circuit fabrication.

To make matters worse, the complicated three-dimensional (3D) geometry makes the circuit highly microwave lossy and thermally fragile (low heat tolerance), so that thermal loading owing to wall-dissipated energy of an amplified output wave, plus the dissipated energy of intercepted beam electrons, can easily distort (or even melt) the circuit.

Solution to Problem

The present invention overcomes disadvantages of conventional devices to greatly extend vacuum electronic microwave amplifier technology to higher power at higher frequency and bandwidth, including the frequency range above 1 THz where it has been very difficult to produce microwave sources.

The present invention is a high-frequency traveling-wave tube interaction circuit employing a modified double vane structure and preferably utilizing a sheet electron beam.

Advantageous Effects of Invention

The present invention establishes a circuit configuration wherein the vanes do not overlap to produce a microwave signal that is essentially confined to the electron beam tunnel where it is highly interactive. This circuit is useful for making improved millimeter and sub-millimeter wave amplifiers or oscillators in that it has higher power and wider instantaneous bandwidth capability than previous circuits, dimensional tolerance, simple fabrication, mode stability, very low loss, high efficiency, and excellent thermal and mechanical ruggedness.

The circuit vanes do not overlap in the present invention and this feature allows for the electron beam to be relatively much larger. The present invention permits higher-current, sheet-electron beams to be used that can be essentially, the full width of the circuit, with much higher current and power, and the tube power to be much larger than for any prior art microwave traveling wave tube at similar frequency.

The prior art difficulties in cutting a hole for the electron beam tunnel, or a making a spiral for the radio frequency (RF) signal, is now eliminated. The present invention makes it easy to manufacture a circuit for very short wavelengths (very high frequency).

Another advantage of the present invention is that the output power level and bandwidth can be systematically adjusted by a dimensional change in the circuit.

Another advantage of the present invention is that the overmoding issue is avoided (i.e. the generation of undesirable modes which results in spurious signals), which usually arises in conventional high-aspect-ratio structures. The present invention makes it relatively easy to design a high aspect ratio sheet electron beam amplifier or oscillator.

The present invention enables the use of a sheet electron beam in a microwave tube and this has advantages in considerably reducing beam density required in the interaction, and, simultaneously reducing the RF power density on the circuit, magnetic focusing requirements, and cathode current density loading.

The present invention maximizes the advantages of a sheet electron beam by enabling use of a wider sheet beam than previously possible, which necessarily enables a lower beam density and lower magnetic field focusing requirement for a given total beam current, or a higher total beam current for a given beam density; thus providing for even higher power capability.

Compared to the prior art, the present invention more easily enables integration of the circuit with vacuum tube elements such as electron gun, collector, windows, couplers, and magnet by means of conventional machining or state-of-the-art MEMS technology.

The present invention is a circuit employing a simple two-dimensional circuit structure, which can be fabricated by a single MEMS process (of the top and bottom vane structures) without need for additional machining. This solid body circuit structure without a separated rod is much more robust and rugged to the thermal loading from wave dissipation and intercepted beam electrons as compared to the folded waveguide circuit.

The present invention enables a relatively easy adaptation to mass production of high power radiation sources for millimeter and sub-millimeter wave applications.

The present invention delivers a superior interaction circuit compared to the prior art, having a higher efficiency in delivering amplification or oscillation. The circuit structure of the present invention can produce gains of above 30 dB and efficiencies of 3% with bandwidths of 30% to very high frequencies including sub-millimeter wave frequencies. The efficiency exceeds 3% at 220 GHz, which is an excellent efficiency at this frequency for a traveling-wave tube, and peaks to approximately 5% at the high frequency end of the band. The simple and robust structure, which is very low in radio frequency loss and very efficient, can sustain the dissipated heat loading of a high power amplified output RF, or electromagnetic (EM), wave and intercepted beam electrons. More information on the test results is found in APPLIED PHYSICS LETTERS 92, 091501, 2008 in an article by the inventors titled, "Intense wideband terahertz amplification using phase shifted periodic electron-plasmon coupling," last accessed online on Oct. 10, 2008 at http://dx.doi.org/10.1063/1.2883951.

Operation of the present invention in its lowest mode is advantageous to avoid undesired instability factors such as overmoding (mode-competition), parasitic self-oscillation, noise background generation, etc. This fundamental mode, second space harmonic (n=1) structure is relatively large compared to the (free space) wavelength of operation, and is very mechanically and thermally robust (compared to conventional circuits).

The circuit structure of the present invention can be made physically much wider by operating in higher order transverse modes, e.g. transversely similar to TE20 or TE30, etc., rectangular waveguide modes. This overmoded operation allows operation at even higher frequencies and/or higher power levels than its fundamental mode.

The present invention enables operation in the fundamental transverse mode with very large width dimensions such that higher order transverse modes can simultaneously propagate. In such an overmoded case, it can be desirable to operate in the fundamental space harmonic (n=0) to reduce/eliminate mode competition with the higher order modes. While the instantaneous bandwidth of such a structure would be relatively narrow, the device would be beam voltage tunable over a wide band, and the frequency and power capability would be very high as compared to conventional circuits.

The present invention can employ practical circuit traveling-wave tube designs to 1 terahertz and higher, fundamental and overmoded, with high output power.

The traveling-wave tube circuit of the present invention can be used to make all forms of microwave tube amplifiers or oscillators. Oscillators can be made applying reflections at the ends of circuit sections to form cavities. Such cavities would be very broadband tunable due to the inherent wide bandwidth of the circuit.

Similarly, klystron amplifiers and klystron oscillators using the present invention with or without cavities can be made. Broadband tuning backward-wave oscillators (BWO) can also be made using the circuit by operating the beam-wave synchronism in backward-wave regions of the circuit dispersion. These improved devices, and others, are logical and obvious applications of the present invention to those skilled in the art of microwave tubes.

BRIEF DESCRIPTION OF DRAWINGS

The drawings show preferred embodiments of the invention and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
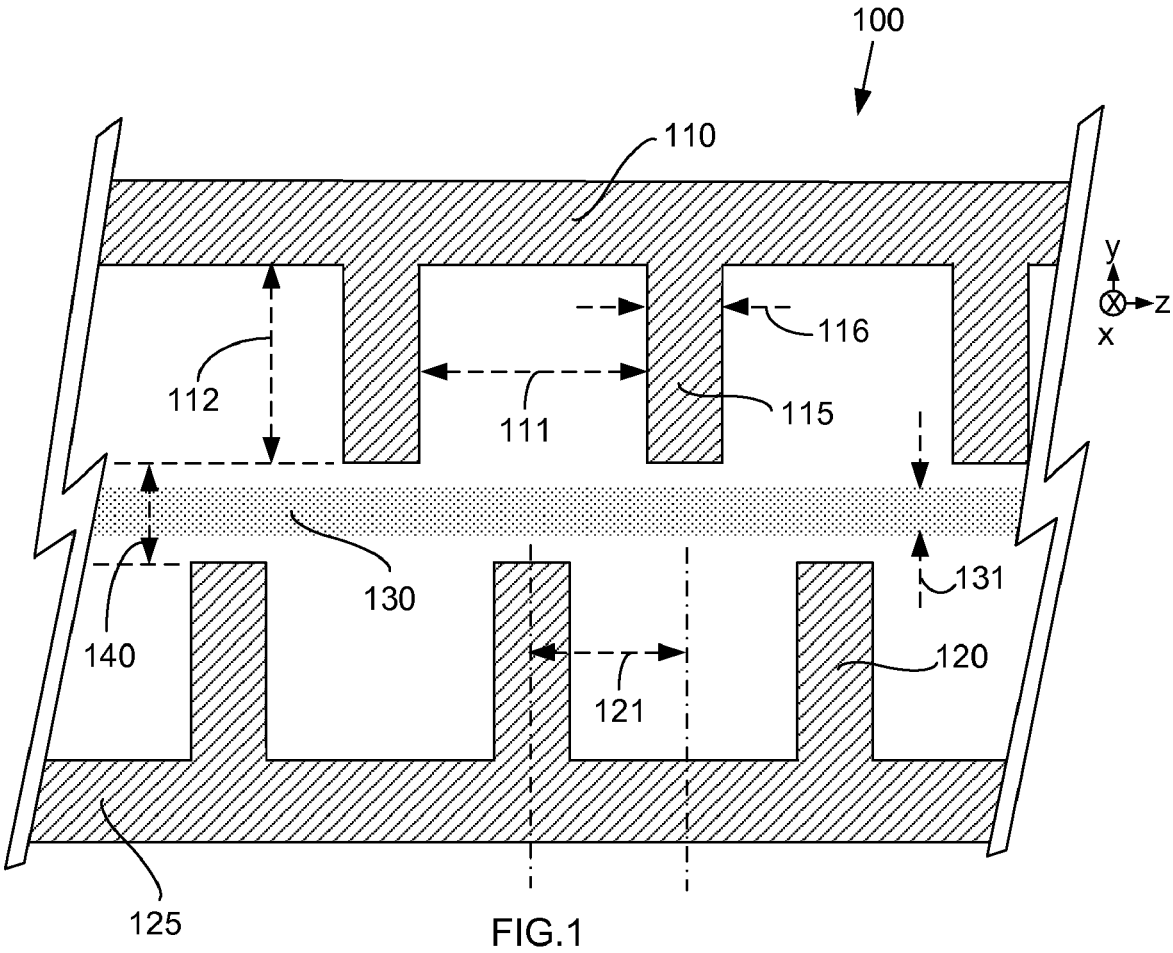
FIG. 1 is a side elevation view of a representative portion of the circuit.
Figure 3:
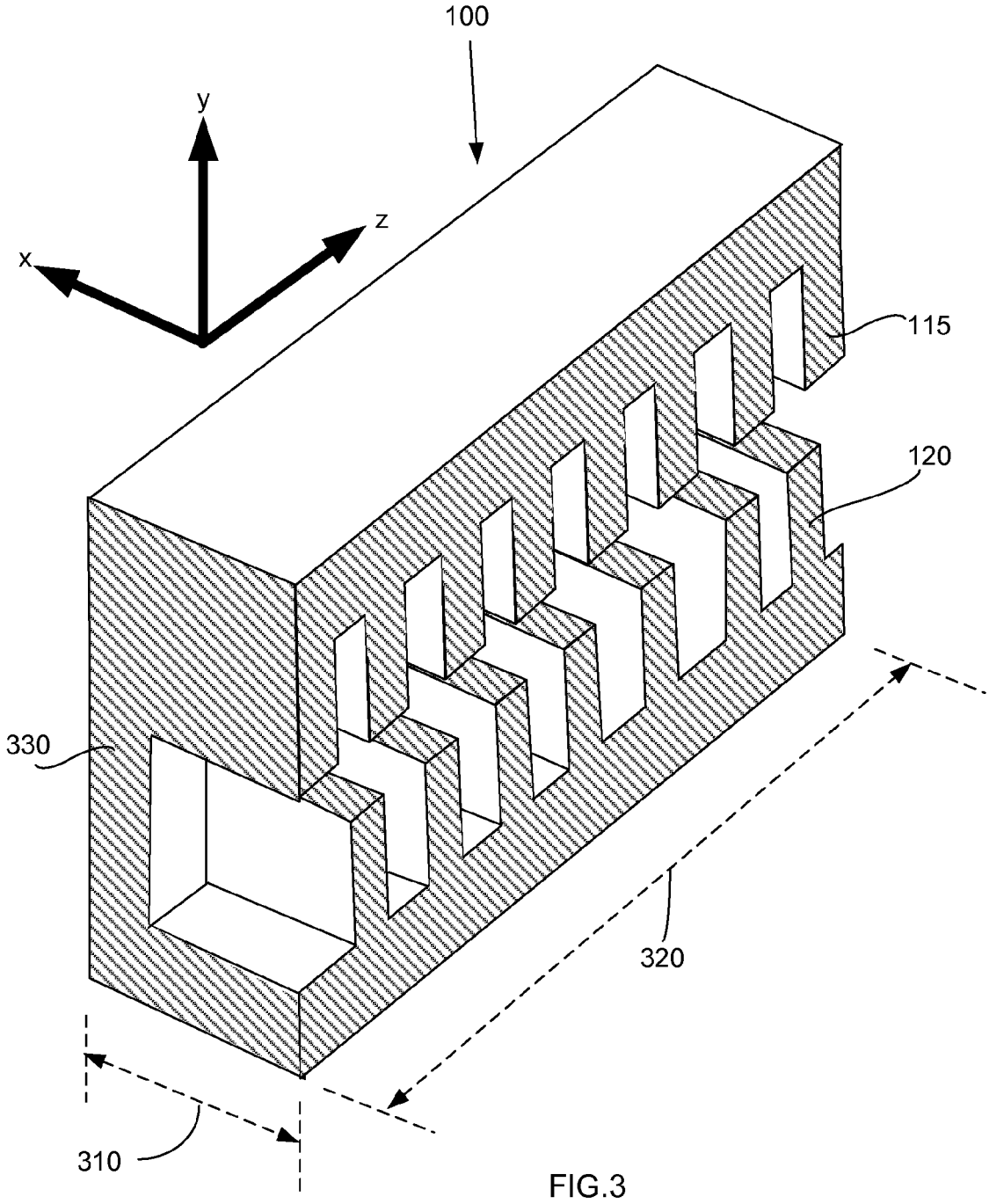
FIG. 3 is a perspective view of the vanes in a representative portion of the circuit.

FIG. 1 and FIG. 3 illustrate a representative portion of a circuit (100) comprising a solid body having a length (320), a top section (110) of electrically conducting material and a bottom section (125) of electrically conducting material. The circuit (100) is for a traveling-wave tube for millimeter and sub-millimeter electromagnetic waves.

Figure 2:
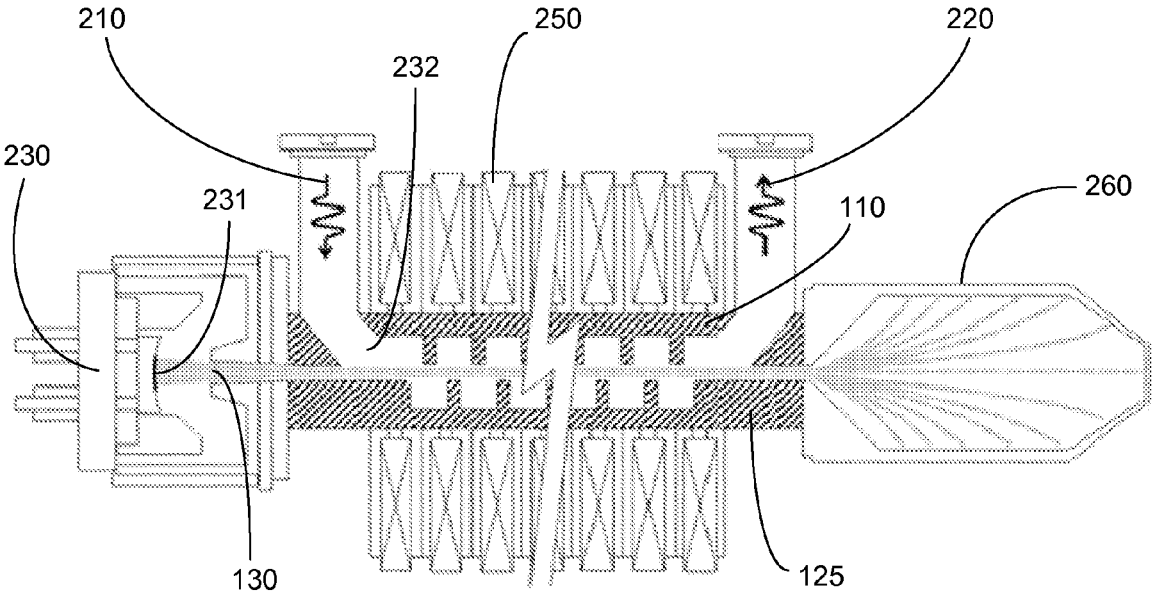
FIG. 2 is a side elevation view of the circuit in a traveling-wave tube.

FIG. 2 shows a side elevation view of the top section (110) and a bottom section (125) of the circuit (100) within a typical traveling-wave tube.

FIG. 3 is a perspective of the vanes (115 and 120) of the circuit (100). In the preferred embodiment, the top section (110) and the bottom section (125) are connected at the sides by conductive material that totally encloses the circuit to make it an enclosed waveguide loaded with staggered vanes. An alternative embodiment of the circuit employs dielectric side walls connecting the top section (110) and the bottom section (125) and forming the solid body. An alternative embodiment employs only a single side wall (330) as shown in FIG. 3, wherein the tunnel is consequently defined by the top section (110), the bottom section (125) and a side of the solid body.

The function of the circuit (100) is to synchronously interact a RF or EM wave with an electron beam (130) in a vacuum electronic microwave amplifier or oscillator. The circuit (100) is two-dimensional in regard to two dimensions for the flow path of the RF signal moving sinusoidally along the axis or length (320) of the circuit to synchronously interact with the electron beam, rather than in three dimensions, such as in interleaved and helix-derived circuits.

The solid-body has a length (320), typically running along the traveling-wave tube axis. The top section (110) is configured with a plurality of vertical vanes (115) having a width (310) and height (112). The vanes are configured parallel to each other. The bottom section (125) is configured with a plurality of vertical vanes (120) having a width (310) and height (112). The vanes (115) on the top section (110) and the vanes (120) on the bottom section (125) are preferably, but not necessarily, of the same dimensions in width (310), height (112) and thickness (116).

The vanes (115) on the top section (110) and the vanes (120) on the bottom section (125) are configured parallel to each and such that when the structure is viewed in cross section along the length (320), the vanes (120) on the bottom section (125) are staggered with respect to the vanes (115) on the top section (110). The period (121) of the stagger is altered in various embodiments to obtain a desired amplification or oscillation. The top section (110) and the bottom section (125) are separated from each other by a distance (140) to define a tunnel through the structure along the length (320). Thus, the circuit (100) has staggered periodic vanes along the beam tunnel. The half-period-staggering between the top section (110) and the bottom section (125) allows in-phase symmetric axial electric field across the beam area to be the most dominant interaction mode.

Dimensional parameters of the circuit (100) are determined by the operational conditions and aspect ratio of the electron beam, which should be evident to a person skilled in the art. By changing the dimensional ratio between the vane and the beam tunnel, it is possible to selectively adjust the bandwidth and the impedance of an operating passband. Thus, the bandwidth and the impedance are inversely proportional and proportional to the dimensional ratio, respectively. The example given below of the test device of the dimensions described was for a 220 GHz device. Thus, a person skilled in the art would know that to make a 110 GHz device, there would be a doubling of every dimension, or to make a 440 GHz device there would be a halving every dimension, etc. It is equally apparent, that other dimensions can be used even for a 220 GHz frequency. For example, a beam of 0.08 mm thick by 0.5 mm wide would work just fine, or 0.12 mm by 0.6 mm, etc.

The electron beam (130) is preferably a sheet electron beam, which is well known in the art and is produced by means well known in the art. The sheet electron beam is preferably focused by a magnetic system, which is also well known in the art.

In the traveling-wave tube shown in FIG. 2, the electron beam (130) is emitted from a cathode surface (231) in the electron gun (230). The electron beam is preferably formed into a sheet beam. The sheet beam passes through the RF circuit via the tunnel thereby continuously interacting with an input RF signal (210), which is typically fed through an input port waveguide with vacuum window. An amplified RF signal (220) is coupled out, typically through an output port waveguide with vacuum window. The sheet electron beam is focused and/or confined by a magnetic system (250) comprising of a permanent magnet or periodic permanent magnet (as is known in the art) and exits the interaction circuit to be collected by the collector (260). Typically, the vacuum windows are within the input and output waveguides as the interior of the device is under high vacuum.

To improve overall system efficiency, the circuit may be used in a traveling-wave tube in combination with a collector (260) that is a depressed collector for sheet electron beam energy recovery. A depressed collector is well known in the art.

Figure 4:
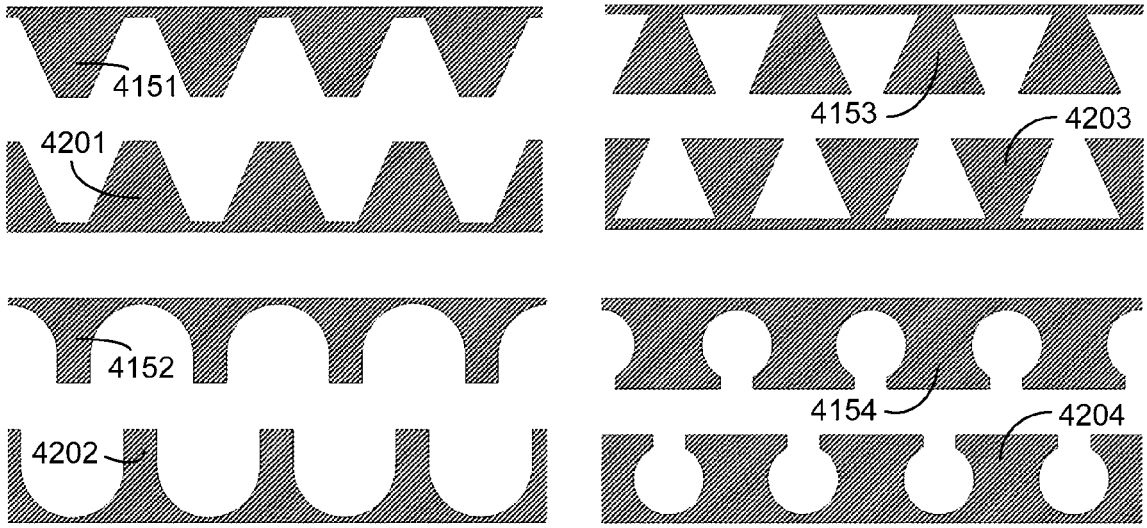
FIG. 4 shows side elevation views of four alternative embodiments of vane shapes.

Circuits with a variety of geometric vane shapes are within the scope of the invention. For example, FIG. 4 shows side elevation views of four alternative embodiments of vane shapes. Top section vanes (4151, 4152, 4153 and 4154) are paired with bottom section vanes (4201, 4202, 4203 and 4204), respectively, in half-period-staggering. These are typical variations, which are geometrically modified to increase bandwidth, interaction strength/impedance, efficiency, avoid overmoding and spurious mode generation as beam power and/or frequency is increased. Other variations, for example in the period, are also within the scope of the invention.

EXAMPLE

The circuit of the invention has been tested in a traveling wave tube comprising a center frequency of 220 GHz, wherein the sheet electron beam has a width to height of 7 to 1, is 0.100 millimeters thick and 0.700 millimeters wide wherein the electrically conductive material of the solid-body is copper, the length is 38 millimeters; all of the vanes are configured with a period of 0.46 millimeters, a thickness of 0.115 millimeters, a height of 0.270 millimeters and a width of 0.770 millimeters; and, the tunnel is 0.150 millimeters in height. Thus, the sheet electron beam fills 67% of the tunnel (the sheet beam size is 0.700 millimeters (x) by 0.100 millimeters (y), which corresponds to a 7:1 aspect ratio).

The example dimensions are tentatively designed for the first space harmonic (n=1) operation with a 20 kilovolt electron beam, though operation in the fundamental (n=0) space harmonic can be accomplished with shorter period. The advantage of the n=1 operation is that the circuit period of 0.46 millimeters is relatively very large in the 220 GHz example, and the vane height (y dimension) to length (z dimension) aspect ratio is very low, only 2.3, allowing excellent heat dissipation (from RF losses and beam current interception on the vane tips).

The circuit characteristics were obtained from the field distribution and dispersion curve using finite-difference-time-domain (FDTD) computer simulation. The circuit has a sinusoidal axial field component along the circuit, which synchronously interacts with the electron beam. This longitudinal field couples between periods through the beam tunnel. The circuit wave has wide velocity matching with the electron beam, which is appropriate for broad bandwidth operation.

Application of the three-dimensional MAGnetric Insulation Code (MAGIC-3D) based on a finite-difference-time-domain (FDTD) and particle-in-cell (PIC) algorithm numerically confirms the superiority and improvement of the state of the art of the circuit of the present invention. The simulation result shows that an input signal of 220 GHz and 50 milliwatts rapidly grows in amplitude along the axial distance by the beam-circuit interaction to a peak power of 164 Watts. In a traveling-wave tube, a 3.8 centimeters (cm) length of the circuit would be terminated into the output coupler/waveguide. In this case, the total saturated power gain is 35 decibels (dB). Longer interaction lengths would be used for lower input drive signal and higher total gain.

A plot of growth rate and peak output power versus frequency was obtained from a driving frequency scan in the MAGIC-3D simulation, to describe the performance characteristics of the circuit. The linear growth rate exceeds 10 dB/cm over the 200 to 270 GHz frequency range, which corresponds to a very useful "hot bandwidth" of approximately 70 GHz (30%), and is 13 dB/cm at 220 GHz. The linear growth rate is the growth of the amplified wave in dB/cm of the linear amplification region, or the region between the input bunching and output saturation regions.

The example describes a large bandwidth oriented circuit structure. As noted above, the circuit geometry can be modified for a high-power narrower-bandwidth-oriented structure, if desired. A MAGIC-3D simulated saturated output power of the example circuit versus frequency shows very high power produced for the 70 GHz band about 220 GHz, and includes the losses of copper. The efficiency exceeds 3% at 220 GHz, which is an excellent efficiency at this frequency for a traveling-wave tube, and peaks to approximately 5% at the high frequency end of the band. The interaction efficiency can be further improved by techniques of phase velocity tapering of the circuit.

The calculated loss in the example 220 GHz, n=1 circuit was 0.04 dB per period, or about 0.9 dB/cm. This is unusually low loss for a slow wave circuit at this frequency (which normally is in the several to 10 dB/cm range), and the very low aspect ratio of the vanes (~2) will permit unusually high average RF power to be produced. In the 220 GHz example with 100 Watts CW (continuous wave) of RF output power, and 0.115 mm vane thickness and 0.270 mm vane height, it is estimated that there was only a 4 degree Centigrade increase of vane tip temperature. Similarly, heat dissipation from electron beam interception on the vane tips will be excellent. The loss is so low that techniques used in low frequency traveling-wave tubes, such as adding loss to the linear growth region and severs, will typically be needed to prevent reflection instability (due to reflections at the input and output of the circuit).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has applicability to the microwave, millimeter wave, and sub-millimeter wave tube industry.

What is claimed is:

1. A two-dimensional circuit for a traveling-wave tube for millimeter and sub-millimeter electromagnetic waves to synchronously interact with an electron beam in a vacuum electronic microwave amplifier or oscillator comprising a solid body having a length, the solid body comprising a top section of electrically conducting material and a bottom section of electrically conducting material, wherein the top section is configured with a plurality of vertical vanes having a width and height and configured parallel to each other, and the bottom section is configured with a plurality of vertical vanes having a width and height and configured parallel to each and such that when the solid body is viewed in cross section along the length, the vanes on the bottom section are staggered with respect to the vanes on the top section and wherein the top section and the bottom section are separated from each other to define a tunnel through the solid body along the length.

2. The circuit of claim 1 further comprising a means for producing a sheet electron beam through the tunnel wherein the sheet electron beam is focused by a magnetic system.

3. The circuit of claim 2 further comprising a depressed collector in a traveling-wave tube for sheet electron beam energy recovery.

4. The circuit of claim 2 for a traveling wave tube comprising a center frequency of 220 gigahertz, wherein the sheet electron beam has a width to height of 7 to 1.

5. The circuit of claim 4 wherein the sheet electron beam is 0.100 millimeters thick and 0.700 millimeters wide.

6. The circuit of claim 1 for a traveling wave tube comprising a center frequency of 220 gigahertz wherein: the solid-body electrically conductive material is copper; the length is 38 millimeters; the vanes are configured with a period of 0.46 millimeters, a thickness of 0.115 millimeters, a height of 0.270 millimeters and a width of 0.770 millimeters; and, the tunnel is 0.150 millimeters in height.

7. The circuit of claim 1 wherein the tunnel is further defined by a side of the solid body.

* * * * *